US008616865B2

(12) United States Patent
Hong et al.

(10) Patent No.: US 8,616,865 B2
(45) Date of Patent: Dec. 31, 2013

(54) CHEMICAL LIQUID FEEDING DEVICE

(75) Inventors: Sa-Mun Hong, Angeong-si (KR); Hyung Il Kim, Anseong-si (KR)

(73) Assignee: C & G Hi Tech Co., Ltd. (KR)

( * ) Notice: Subject to any disclaimer, the term of this patent is extended or adjusted under 35 U.S.C. 154(b) by 140 days.

(21) Appl. No.: 13/056,574

(22) PCT Filed: Sep. 10, 2008

(86) PCT No.: PCT/KR2008/005329

§ 371 (c)(1),
(2), (4) Date: Jan. 28, 2011

(87) PCT Pub. No.: WO2010/024488

PCT Pub. Date: Mar. 4, 2010

(65) Prior Publication Data

US 2011/0174400 A1 Jul. 21, 2011

(30) Foreign Application Priority Data

Aug. 29, 2008 (KR) ..... 10-2008-0084893

(51) Int. Cl.
*F04B 45/02* (2006.01)
*F04B 41/06* (2006.01)
*F16J 3/04* (2006.01)

(52) U.S. Cl.
USPC ..... 417/473; 417/3; 92/37

(58) Field of Classification Search
USPC ..... 417/472, 473, 521, 3, 4, 5, 6, 7, 8, 62, 417/320, 392, 394, 533, 539; 92/37, 40; 137/565.3, 565.33, 565.29
See application file for complete search history.

(56) References Cited

U.S. PATENT DOCUMENTS

| | | | | | |
|---|---|---|---|---|---|
| 4,302,163 | A | * | 11/1981 | Hope et al. | 417/473 |
| 4,832,580 | A | * | 5/1989 | Tsuyoshi et al. | 417/290 |
| 4,869,397 | A | * | 9/1989 | Corniea et al. | 222/63 |
| 2008/0138214 | A1 | | 6/2008 | Yajima | |
| 2008/0226466 | A1 | * | 9/2008 | Eysymontt | 417/53 |

FOREIGN PATENT DOCUMENTS

| | | | |
|---|---|---|---|
| JP | 2003-148353 | A | 5/2003 |
| KR | 10-2002-0029976 | A | 4/2002 |
| KR | 10-2003-0048515 | A | 6/2003 |
| WO | WO2005119063 | * | 12/2005 |

* cited by examiner

*Primary Examiner* — Bryan Lettman
(74) *Attorney, Agent, or Firm* — Harness, Dickey & Pierce, P.L.C.

(57) ABSTRACT

A chemical liquid feeding device for feeding chemical liquid used in a semiconductor fabrication process. The device includes three or more pumps arranged in a line. Each pump has different time points of suction stroke and discharge stroke so that the chemical liquid can be fed uniformly without pulsation.

14 Claims, 3 Drawing Sheets

CHEMICAL LIQUID FEEDING DEVICE

CROSS-REFERENCE TO RELATED APPLICATIONS

This application is a National Stage of International Application No. PCT/KR2009/005329 filed Sep. 10, 2008. This application claims the benefit and priority of Korean Application No. 10-2008-0084893, filed Aug. 29, 2008. The entire disclosures of the above applications are incorporated herein by reference.

BACKGROUND

This section provides background information related to the present disclosure which is not necessarily prior art.

1. Technical Field

The present invention relates to a chemical liquid feeding device, and more particularly, to a chemical liquid feeding device capable of feeding uniformly chemical liquid required in a semiconductor fabrication process without pulsation.

2. Discussion

A semiconductor fabrication process consists of three steps: design of a wafer circuits, processing of the wafer and assembly/inspection. In an etch process and cleaning process of the wafer processing process, there are used chemical liquids for etching or cleaning the wafer (hereinafter, referred to as chemical liquids).

As is known in the art, the semiconductor fabrication process is a process of producing a product with high precision. Therefore, an exact mixing ratio of the chemical liquids used in this semiconductor fabrication process and uniform feeding of the chemical liquids are very important.

The uniform feeding of the mixing ratio is made by feeding device including a diaphragm or bellows pump. FIGS. 1 to 3 show this conventional feeding device: FIG. 1 is a plan view showing a main structure of a conventional chemical liquid feeding device; FIG. 2 is a front view showing an operation of the chemical liquid feeding device of FIG. 1; and FIG. 3 is a graph showing suction and discharge processes according to time of the chemical liquid feeding device of FIG. 1.

As shown in FIG. 1, the conventional feeding device 200 includes two bellows pumps 210, 212. The two bellows pumps 210, 212 are installed so that they face with each other with a body of the feeding device being placed therebetween and operate so that time points of suction stroke and discharge stroke of the pumps are not agree with each other (refer to FIG. 3). Accordingly, the conventional feeding device 200 has an advantage of capable of feeding a chemical liquid uniformly since the pump 212 discharges the chemical liquid when the pump 210 sucks in the chemical liquid.

However, this conventional chemical liquid feeding device has the following disadvantages due to the installation structure of the pumps 210, 212.

First, there is a limitation in increasing a flow rate.

The conventional chemical liquid feeding device 200 consists of two facing bellows or diaphragm pumps. Accordingly, it is required for the conventional chemical liquid feeding device 200 to enlarge a size of the bellows or diaphragm to increase the flow rate but it is difficult to enlarge the size of the bellows or diaphragm due to the structure or cost.

Second, it is difficult to clean the pump due to the chemical liquid and it is also difficult and dangerous to replace the pump.

In the conventional chemical liquid feeding device 200, since the bellows pumps 210, 212 are installed with being laid on their sides, a large amount of the chemical liquid is always remained in an inside of the pumps 210, 212 (particularly, in folding portions in the bellows pump which expands and contracts). However, most of the chemical liquids 300 are generally harmful to human body and there is high risk of damage to the human body due to leakage of the chemical liquid when a connection port is disconnected and reconnected for the replacement of the pump. Also, in a case that a fine abrasive for cleaning or washing a semiconductor wafer is contained, there is a high possibility that the abrasive is remained in the pumps 210, 212 to abrade the major parts (the folding portion of the bellows pump or diaphragm of the diaphragm pump) of the pumps 210, 212.

Therefore, in the conventional chemical liquid feeding device 200, there occur problems that the bellows pumps 210, 212 cannot be used until their predetermined life time and an efficiency of pumps is remarkably lowered according to a long time use.

Third, considerable pulsation is generated when feeding the chemical liquid.

The conventional chemical liquid feeding device 200 can generally feed the chemical liquid uniformly since the two bellows pumps 210, 212 operate so as to have opposite time points of suction and discharge as described above.

However, in the conventional chemical liquid feeding device 200, since a period of conversion from a time point of maximum discharge T1 by the pump 210 to a time point of maximum discharge T3 by the pump 212 is clearly distinguished and is long as shown in FIG. 3, pulsation according to repetition of the suction and discharge strokes is very remarkable and a pressure difference at a time point T2 of conversion from T1 to T3 is very large.

Accordingly, the conventional chemical liquid feeding device 200 has a disadvantage that large and small vibrations and noises are generated in the chemical liquid feeding process due to the pulsation and also has a disadvantage that final discharge pressure of the chemical liquid becomes irregular due to pressure reduction generated at every time point of conversion of the discharge stroke.

SUMMARY OF THE INVENTION

An object of the present invention is to provide a chemical liquid feeding device, which can feed a chemical liquid uniformly without pulsation, allows for manufacture of a large capacity feeding device and has no remaining of the chemical liquid to minimize a harmful factor to a human body upon replacement of a pump.

To achieve the above objects, the present invention provides a chemical liquid feeding device includes three or more pumps arranged in a line, each pump having different time points of suction stroke and discharge stroke from one another.

Preferably, the pumps are bellows pumps and the chemical liquid feeding device further includes a suction pipe for integrally connecting suction ports of the pumps and a discharge pipe for integrally connecting discharge ports of the pumps.

Preferably, the pumps have the suction port and discharge port disposed along a gravity direction so as not to remain and to discharge all chemical liquid flowing in an inside of the pump, respectively.

Preferably, a sequence of the suction strokes and the discharge strokes of the pumps are independently of a sequence of the arrangement of the pumps.

Preferably, the chemical liquid feeding device further includes a control means for controlling the sequence of the suction strokes and the discharge strokes of the pumps.

The chemical liquid feeding device according to the present invention can feed the chemical liquid without pulsation and can feed the chemical liquid at a supply pressure more regular than that of the conventional one.

Also, the chemical liquid feeding device according to the present invention can prevent effectively accident on a manager and abrasion and damage of the pump due to the chemical liquid since the chemical liquid is not remained in an inside of the pump.

BRIEF DESCRIPTION OF THE DRAWINGS

The above and other objects, features and advantages of the present invention will become apparent from the following description of preferred embodiments given in conjunction with the accompanying drawings.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Hereinafter, the embodiments of the present invention will be described in detail with reference to accompanying drawings.

In the following description of the present invention, terms used herein are defined in consideration of functions in the present invention and are not intended to be limiting of the invention.

Figure 1:
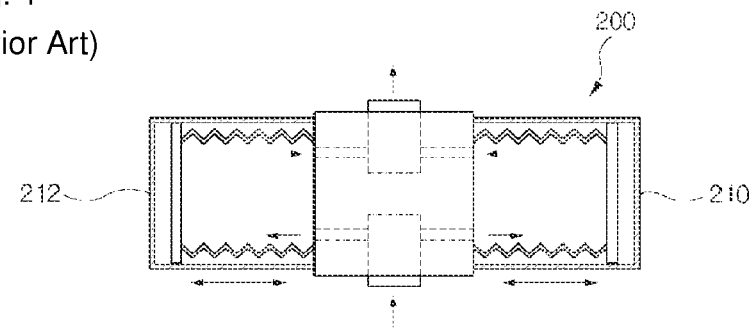
Fig. 1 (Prior Art)
FIG. 1 is a plan view showing a main structure of a conventional chemical liquid feeding device.
Figure 2:
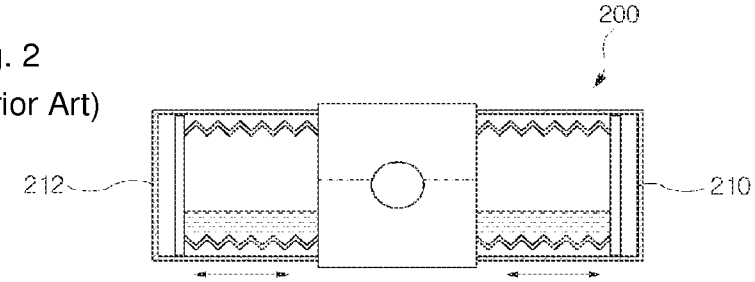
Fig. 2 (Prior Art)
FIG. 2 is a front view showing an operation of the chemical liquid feeding device of FIG. 1.
Figure 3:
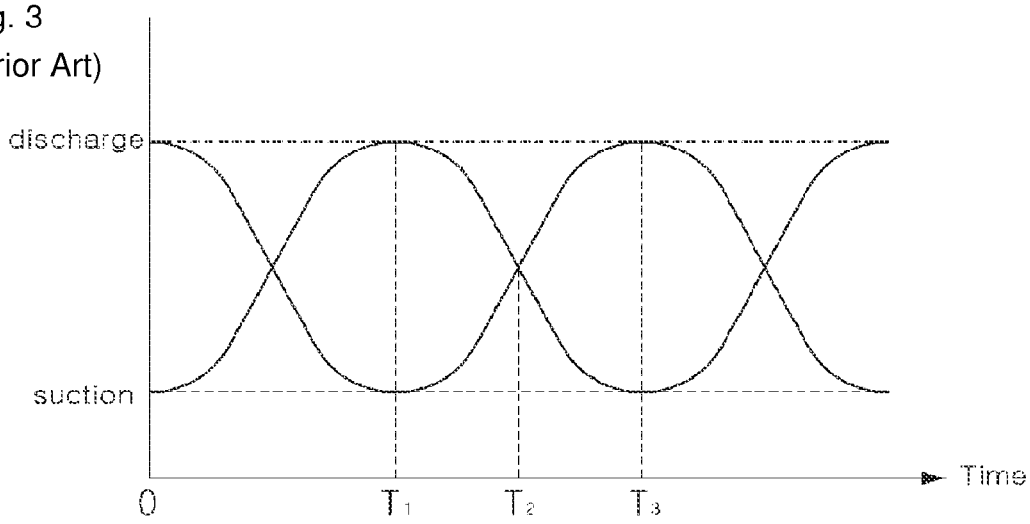
Fig. 3 (Prior Art)
FIG. 3 is a graph showing suction and discharge processes according to time of the chemical liquid feeding device of FIG. 1.
Figure 4:
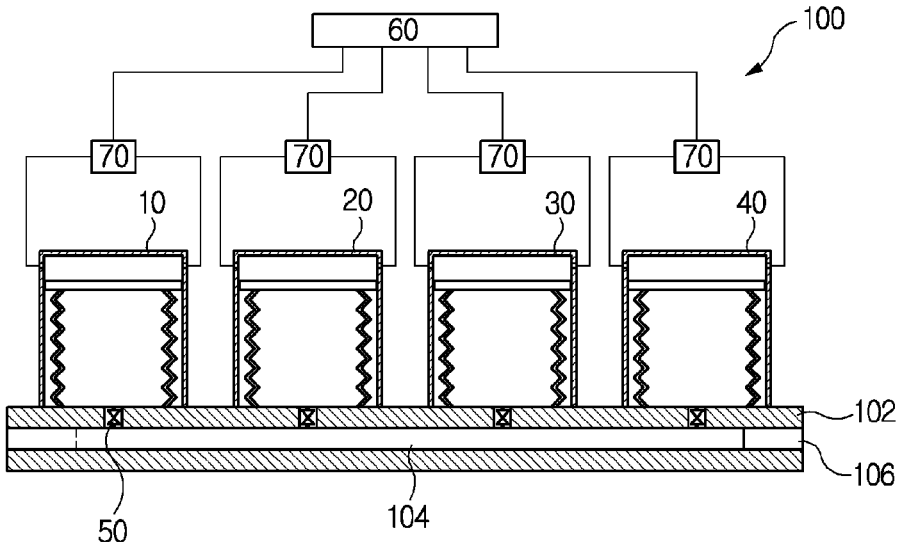
FIG. 4 is a partial sectional view showing a main structure of a chemical liquid feeding device according to a first embodiment of the present invention.
Figure 5:
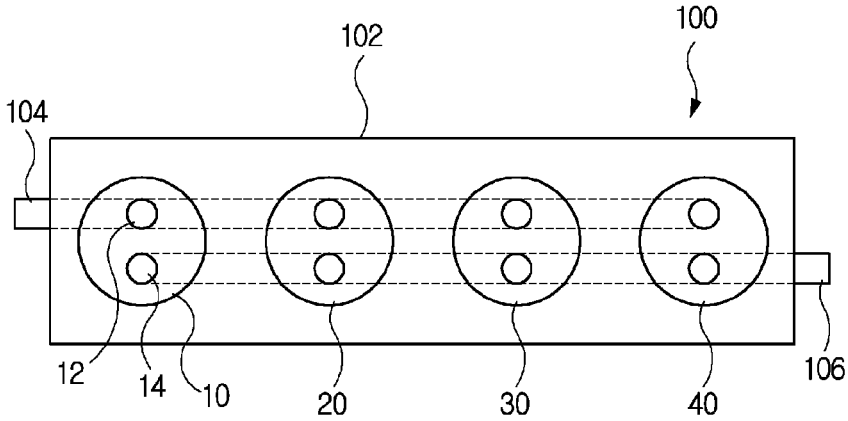
FIG. 5 is a plan view showing the chemical liquid feeding device of FIG. 4.
Figure 6:
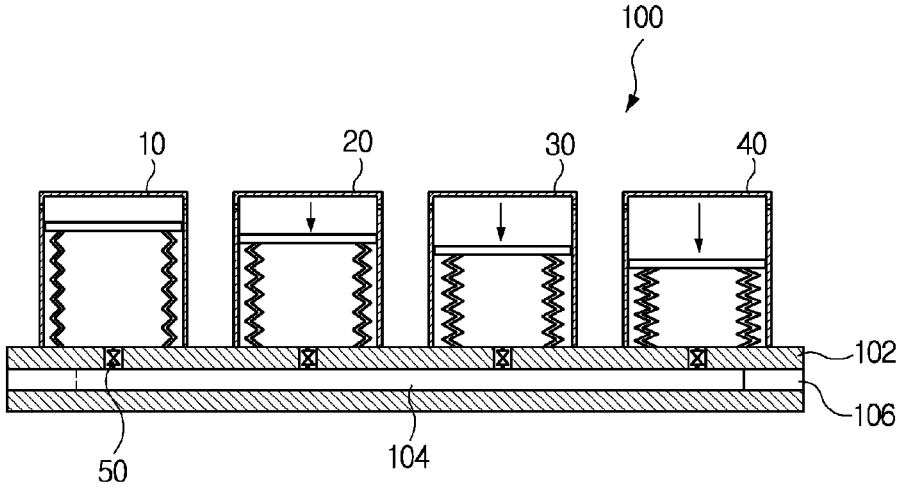
FIG. 6 is a side view showing an operation of the chemical liquid feeding device of FIG. 4.
Figure 7:
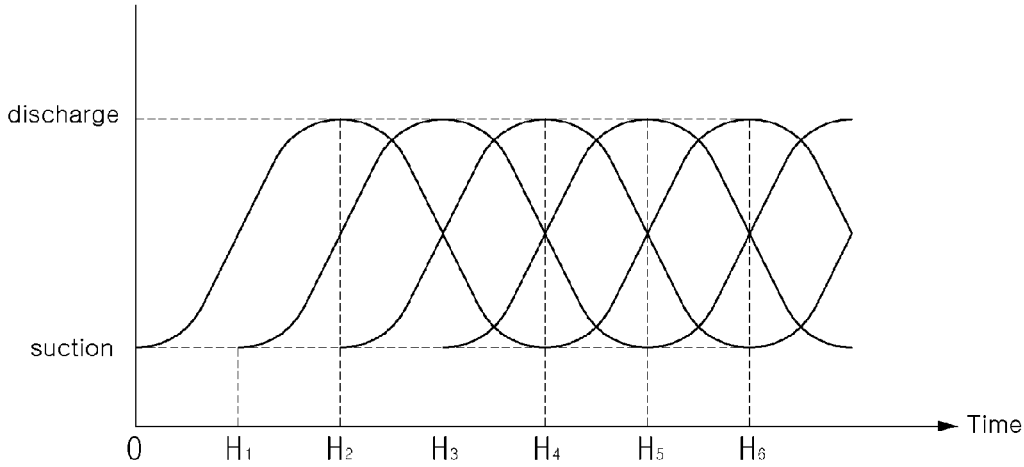
FIG. 7 is a graph showing suction and discharge processes according to time of the chemical liquid feeding device of FIG. 4.

FIG. 4 is a partial sectional view showing a main structure of a chemical liquid feeding device according to a first embodiment of the present invention; FIG. 5 is a plan view showing the chemical liquid feeding device of FIG. 4; FIG. 6 is a side view showing an operation of the chemical liquid feeding device of FIG. 4; and FIG. 7 is a graph showing suction and discharge processes according to time of the chemical liquid feeding device of FIG. 4.

As shown in FIGS. 4 and 5, a chemical liquid feeding device 100 according to the present invention includes a housing 102, a plurality of pumps 10, 20, 30, 40, a pneumatic device 70 and a controller 60.

The housing 102 is a frame formed long so as to allow a serial arrangement of the plurality of the pumps 10, 20, 30, 40 and is provided with a suction pipe 104 for inflow of the chemical liquid and a discharge pipe 106 for discharge of the chemical liquid. The suction pipe 104 is connected with suction ports 12 formed in the respective pumps 10, 20, 30, 40 and the discharge pipe 106 is connected with discharge ports 14 formed in the respective pumps 10, 20, 30, 40.

The plurality of the pumps 10, 20, 30, 40 is arranged in a line above the housing 102. Each of the pumps 10, 20, 30, 40 has the suction port 12 for suction of the chemical liquid and the discharge port 14 for discharge of the chemical liquid, and sucks the chemical liquid in an inside of the pump 10, 20, 30, 40 and then discharge the chemical liquid at a regular pressure through a reciprocating bellows or diaphragm. The suction port 12 and the discharge port 14 are provided with a check valve 50, respectively, so that the chemical liquid flows in a certain direction. That is to say, the suction port 12 is provided with the check valve 50 which allows only for the flow from the suction pipe 104 to the inside of the pumps 10, 20, 30, 40 and the discharge port 14 is provided with the check valve 50 which allows only for the flow from the pumps 10, 20, 30, 40 to the discharge pipe 104.

Although four pumps 10, 20, 30, 40 are shown in the present embodiment, the number of pump can be increased or decreased depending on a size and usage of a fabrication line in which the chemical liquid feeding device 100 according to the present invention is installed. Also, although the plurality of the pumps 10, 20, 30, 40 are arranged in a line so as to simplify arrangement and structure of the suction pipe 104 and the discharge pipe 106 in the present embodiment, the pumps 10, 20, 30, 40 can be arranged in a zigzag or other form capable of increasing arranging efficiency of the pumps provided that the suction ports 12 and the discharge ports 14 are arranged in a gravity direction (i.e. towards a lower side) so that most of the chemical liquid sucked in the pumps 10, 20, 30, 40 can easily flow out by the gravity. For reference, it is preferred that the plurality of the pumps included in the chemical liquid feeding device 100 have the same operation period.

The pneumatic device 70 is placed in the pumps 10, 20, 30, 40, respectively. The pneumatic device 70 supply air to the respective pumps 10, 20, 30, 40 or discharge the air from the pumps 10, 20, 30, 40 according to a control signal of a controller 60 to reciprocate the bellows or diaphragm of the pumps 10, 20, 30, 40. For reference, although the pneumatic device 70 is used in the present embodiment, a hydraulic device having the same or similar function can be used.

The controller 60 is placed in the housing 102 or some portion of the chemical liquid feeding device 100. The controller 60 controls the pneumatic devices 70 of the pumps 10, 20, 30, 40 respectively to adjust time points of respective suction and discharge strokes of the pumps 10, 20, 30, 40 according to a pre-set sequence or an inputted program. For reference, the controller 60 according to the present embodiment controls the pneumatic devices 70 and the pumps 10, 20, 30, 40 so that the suction strokes and the discharge strokes are performed according to the sequence of the pumps 10, 20, 30, 40 arranged in the housing 102 (refer to FIG. 6).

Next, an operation of the chemical liquid feeding device 100 according to the present invention will be described on the basis of FIGS. 6 and 7.

In the chemical liquid feeding device 100 of the present invention, when an operation start signal is received from the outside, the controller 60 detects the signal to determine the operation time points of the pumps 10, 20, 30, 40 according to a pre-set program or a pre-set logic operation. That is to say, the controller 60 divides the period of the suction and discharge strokes of the pumps 10, 20, 30, 40 by the number of the pumps provided in the chemical liquid feeding device 100 and sets up the obtained value as a value of an operation deviation to operate the pumps 10, 20, 30, 40 with a time difference (i.e. the operation deviation value).

Then, the pumps 10, 20, 30, 40 start the operation according to the sequence set by the controller 60. That is to say, as shown in FIGS. 6 and 7, after the suction stroke of the pump 10 set as a first priority by the controller 60 starts, the suction stroke of the pump 20 is started at a time point H1 (a time point passed by the operation deviation value from the time point of starting of the pump 10), the suction stroke of the pump 30 is started at a time point H2 (a time point passed by the operation deviation value from the time point of starting of the pump 20), and the suction stroke of the pump 40 is started at a time point H3 (a time point passed by the operation deviation value from the time point of starting of the pump 30).

Accordingly, the time points H2, H3, H4, H5 of the discharge strokes in the pumps 10, 20, 30, 40 are generated with a time difference corresponding to the operation deviation as shown in FIG. 7. At this time, since the time points H3, H4, H5 of the discharge strokes of the rest three pumps 20, 30, 40 are continuously present between the time point H2 where the discharge stroke of the pump 10 is performed and the time point H6 where the next discharge stroke of the pump 10 is performed, deviation in the discharge pressure between the time points H2, H3, H4, H5 of the discharge strokes is reduced.

Accordingly, according to the present invention, the pulsation generated when feeding the chemical liquid using a plurality of the pumps is considerably reduced.

Also, in the chemical liquid feeding device 100, since the suction ports 12 and the discharge ports 14 of all the pumps 10, 20, 30, 40 are arranged towards the lower side, the chemical liquid is not remained in the inside of the pump.

Accordingly, according to the present invention, it is possible to effectively prevent reduction in the life time and damage of the pump due to the remaining of the chemical liquid in the inside of the pump.

Figure 8:
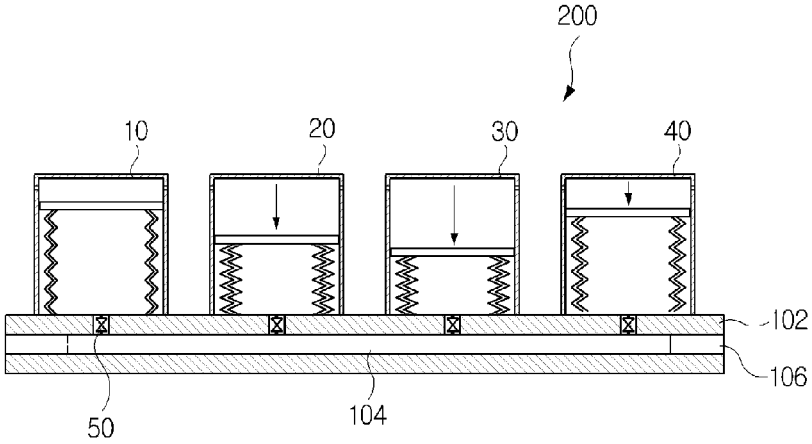
FIG. 8 is a side view showing another example of the operation of the chemical liquid feeding device of FIG. 4.

Next, another example of the operation of the first embodiment will be described. FIG. 8 is a side view showing another example of the operation of the chemical liquid feeding device of FIG. 4.

Another example of the operation of the first embodiment is different from the above described operation in an operation sequence of the pumps 10, 20, 30, 40. In this operation, in consideration that flow in the suction pipe 104 and the discharge pipe 106 becomes unstable or the chemical liquid is not supplied smoothly to the pumps placed at the end portion of the housing 102 when the adjacent pumps 10, 20, 30, 40 operates continuously, the operation sequence of the pumps 10, 20, 30, 40 are varied to solve these problems. Accordingly, according to this technical spirit, any modification can be allowed provided that the pumps 10, 20, 30, 40 do not operate according to the arranged sequence.

Figure 9:
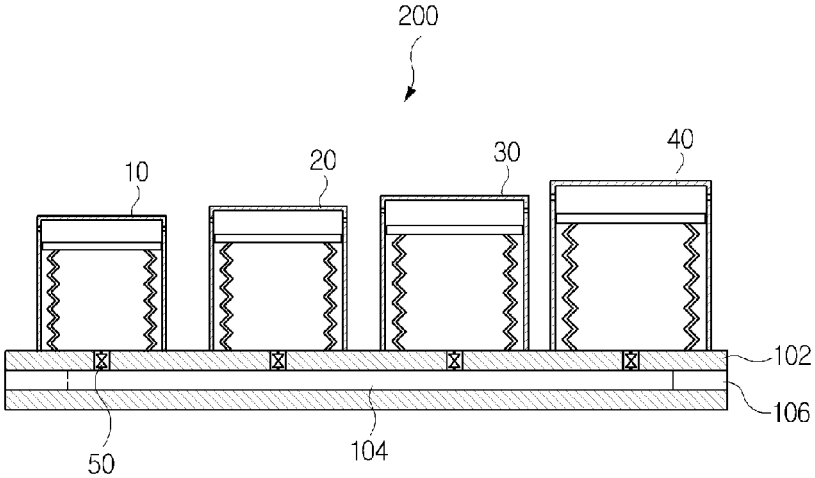
FIG. 9 is a partial sectional view showing a main structure of a chemical liquid feeding device according to a second embodiment of the present invention.

Next, a second embodiment of the present invention will be described. FIG. 9 is a sectional view showing a main structure of a chemical liquid feeding device according to a second embodiment of the present invention. For reference, the structure of the present embodiment is the same as that of the above described embodiment, same numerals are given to the same parts and descriptions thereof will be omitted.

In the second embodiment, sizes of the pumps 10, 20, 30, 40 are different. The pumps 10, 20, 30, 40 of the second embodiment have different sizes from one another, and the size (i.e. capacity) becomes larger as goes from the front of the housing 102 to the rear.

In a case of arranging the plurality of pumps 10, 20, 30, 40 serially as is in the present embodiment, the pump 10 placed in front side and the pump 40 placed in rear side has slightly different suction force. This is because substantial amounts of the chemical liquid fed to the front side and rear side and suction loads of the pumps are slightly different due to the places of the pumps. It is preferred to restrict or minimize this phenomenon, if possible, since this phenomenon generates, though it is insignificant, a deviation in the feeding of the chemical liquid and leaves a basis of error occurrence in a precise semiconductor fabrication process.

In the present embodiment, in consideration of the aforementioned factor, the capacity of the pumps 10, 20, 30, 40 becomes larger as goes from the front of the housing 102 to the rear. This configuration can minimize the aforementioned problems since it makes substantial suction amounts and discharge amounts of the chemical liquid in the frontmost pump 10 and the rearmost pump 40 equal.

For reference, since the second embodiment is suitable for the case that a plurality of pumps (preferably, more than four pumps) is arranged serially, the second embodiment may not be employed if the number of the pump placed is small and is not arranged serially.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A chemical liquid feeding device, comprising:

three or more bellows pumps arranged in a line between an inlet end and an outlet end of a housing, the inlet end at a front of the housing and the outlet end at a rear of the housing, each of the pumps including a suction port and a discharge port, a capacity of each of the pumps increases from the inlet end to the outlet end such that the pumps have a substantially similar suction force, each pump having different time points of a suction stroke and a discharge stroke from one another;

a suction pipe for integrally connecting the suction ports of the pumps; and a discharge pipe for integrally connecting the discharge ports of the pumps;

wherein the suction ports and the discharge ports are arranged along a gravity direction such that chemical liquid within the pumps is discharged from the pumps by gravity.

2. The chemical liquid feeding device of claim 1, wherein a sequence of suction strokes and discharge strokes of the pumps is independent of the arrangement of the pumps.

3. The chemical liquid feeding device of claim 2, further comprising a control means for controlling the sequence of the suction strokes and the discharge strokes of the pumps.

4. The chemical liquid feeding device of claim 1, further comprising a control means for controlling a sequence of suction strokes and discharge strokes of the pumps.

5. The chemical liquid feeding device of claim 1, wherein the suction pipe extends from the inlet end to each one of the pumps, and the discharge pipe extends from each one of the pumps to the outlet end.

6. A chemical liquid feeding device comprising:

a housing including an inlet end and an outlet end opposite thereto;

at least three bellows pumps linearly arranged between the inlet end and the outlet end, the pumps increasing in capacity from the inlet end to the outlet end, each one of the pumps including both a suction port and a discharge port, each pump having different time points of a suction stroke and a discharge stroke from one another, the pumps mounted to the housing such that gravity draws chemical liquid out from within the pumps;

a suction pipe extending from the inlet end to each suction port; and a discharge pipe extending from the outlet end to each discharge port.

7. The chemical liquid feeding device of claim 6, wherein a sequence of suction strokes and discharge strokes of the pumps is independent of the arrangement of the pumps.

8. The chemical liquid feeding device of claim 6, wherein the suction pipe and the discharge pipe are each linear pipes.

9. The chemical liquid feeding device of claim 6, further comprising a controller configured to control a sequence of suction strokes and discharge strokes of the pumps.

10. The chemical liquid feeding device of claim 6, wherein the pumps are serially arranged, and each one of the pumps has a substantially similar suction force.

11. A chemical liquid feeding device comprising:

a housing including an inlet end and an outlet end opposite thereto;

at least three serially connected bellows pumps arranged linearly between the inlet end and the outlet end, the pumps increasing in capacity from the inlet end to the outlet end such that each pump has a substantially similar suction force, each one of the pumps including both a suction port and a discharge port, each pump having different time points of a suction stroke and a discharge stroke from one another, the pumps mounted to the housing such that gravity draws chemical liquid out from within the pumps;

a suction pipe extending from the inlet end to each suction port; and a discharge pipe extending from the outlet end to each discharge port.

12. The chemical liquid feeding device of claim 11, wherein a sequence of suction strokes and discharge strokes of the pumps is independent of the arrangement of the pumps.

13. The chemical liquid feeding device of claim 11, wherein the suction pipe and the discharge pipe are each linear pipes.

14. The chemical liquid feeding device of claim 11, further comprising a controller configured to control a sequence of suction strokes and discharge strokes of the pumps.

* * * * *